US007999700B2

(12) United States Patent
Palazzo

(10) Patent No.: US 7,999,700 B2
(45) Date of Patent: Aug. 16, 2011

(54) SYSTEM AND APPARATUS FOR PREVENTING THEFT FROM VEHICLES

(76) Inventor: Stephen A. Palazzo, Dania Beach, FL (US)

( * ) Notice: Subject to any disclaimer, the term of this patent is extended or adjusted under 35 U.S.C. 154(b) by 302 days.

(21) Appl. No.: 12/393,338

(22) Filed: Feb. 26, 2009

(65) Prior Publication Data

US 2010/0214132 A1 Aug. 26, 2010

(51) Int. Cl.
*G08B 23/00* (2006.01)

(52) U.S. Cl. ..... 340/984; 340/541; 340/551; 340/565

(58) Field of Classification Search ..... 340/984, 340/540, 541, 545.3, 550–561, 565, 567
See application file for complete search history.

(56) References Cited

U.S. PATENT DOCUMENTS 3,760,396 A * 9/1973 Haselton ..... 340/984
5,015,994 A 5/1991 Hoberman
5,319,350 A 6/1994 DeMarco
5,463,595 A 10/1995 Rodhall
5,572,186 A 11/1996 Traxler
5,575,557 A 11/1996 Huang
5,652,567 A * 7/1997 Traxler ..... 340/552
5,790,024 A 8/1998 Ripingill, Jr.
5,867,099 A * 2/1999 Keeter ..... 340/567
6,091,200 A 7/2000 Lenz
6,118,375 A 9/2000 Duncan
6,231,217 B1 5/2001 Krippelz, Sr.
6,265,966 B1 * 7/2001 Ireland et al. ..... 340/426.14
6,956,493 B1 10/2005 Youngblood
7,104,851 B1 * 9/2006 Gonring et al. ..... 440/1

* cited by examiner

*Primary Examiner* — Toan N Pham
(74) *Attorney, Agent, or Firm* — Larson & Larson, P.A.; Frank Liebenow; Justin Miller

(57) ABSTRACT

An application for a theft prevention system includes a self-contained alarm that secures to a structure of a boat or other vehicle, especially a pleasure craft. The self contained alarm includes a motion detector and a signaling device which is either audible or visual. The signaling device lights and/or sounds responsive to detection of motion by the motion detector.

5 Claims, 6 Drawing Sheets

SYSTEM AND APPARATUS FOR PREVENTING THEFT FROM VEHICLES

FIELD OF THE INVENTION

This invention relates to the field of boating and more particularly to a system and apparatus for preventing theft from occurring on a boat.

BACKGROUND

There are many situations in which a vehicle or boat is susceptible to theft. These are categorized by two situations: one in which the vehicle or boat is left unattended and the other is one in which the vehicle or boat is occupied, but the occupants are asleep or otherwise unguarded.

In marine cases where the boat is unattended, the boat is often in a slip or on a boat lift. In most situations, a boat in a slip or on a lift usually has the bow positioned towards a neighboring body of land and the stern faces the open water. Since most boats, especially pleasure craft, are easily accessed from the stern, it is easy for a thief to enter the boat either from the neighboring dock or from another watercraft. This entry is very hard to detect from land being hidden by the structure of the boat, especially at night. Once aboard, it is often very easy to break into the cabin to steal valuables and/or to hot-wire the boat and steal the boat.

In marine cases where the boat is attended and the occupants are asleep, it is often very difficult to detect a thief boarding the boat. Often, when the occupants are asleep in the cabin, valuables such as watches, radios, music players, portable televisions and the like are sitting targets for the thief. The noise of the sea and the natural motion of the boat only help the thief keep from being detected.

What is needed is a system and apparatus that will prevent such thefts by signaling either the occupant or a passer-by of the robbery in progress.

SUMMARY OF THE INVENTION

The theft prevention system includes a self-contained marine alarm that secures to a structure of a boat, especially a pleasure craft. The self contained marine alarm includes a motion detector and a signaling device which is either audible or visual.

In one embodiment, a marine alarm system is disclosed including a base enclosure and a source of power. A motion sensing circuit is affixed to an outside surface of the base enclosure; the motion sensing circuit receives power from the source of power. There is at least one signaling device affixed to the outside surface of the base enclosure. The signaling device(s) receive power from the motion sensing circuit responsive to the motion sensing circuit detecting motion (presence of a person). There is a mechanism for removably connecting the base enclosure to a section of a boat such as a rail and/or a cloth member.

In another embodiment, a marine alarm system is disclosed including a base enclosure and a source of power entering into the enclosure. A motion sensing circuit is affixed to an outside surface of the base enclosure and the motion sensing circuit receives power from the source of power. An electric light is positionably (adjustable) affixed to the outside surface of the base enclosure and it receives power from the motion sensing circuit responsive to the motion sensing circuit detecting motion. An audible alarm is affixed to the outside surface of the base enclosure and also receives power from the motion sensing circuit responsive to the motion sensing circuit detecting motion. There is an attachment mechanism for removably connecting the base enclosure to a section of a boat (e.g., a rail or cloth member).

In another embodiment, a marine alarm system is disclosed including a base enclosure and a source of power entering into the enclosure. A motion sensing circuit is affixed to an outside surface of the base enclosure and receives power from the source of power. An electric light is positionably (able to be adjusted) affixed to the outside surface of the base enclosure and receives power from the motion sensing circuit responsive to the motion sensing circuit detecting motion. An audible alarm is also affixed to the outside surface of the base enclosure and also receives power from the motion sensing circuit through a mute switch responsive to the motion sensing circuit detecting motion. The mute switch prevents power from reaching the audible alarm when the mute switch is in the open position. The base enclosure has one or more fasteners affixed to the outside surface to which an attachment mechanism is removably affixed. The attachment mechanism has an arced clip at one end configured to secure the attachment mechanism to a rail of a boat and a spring clip at a second end configured to secure the attachment mechanism to a cloth part of the boat.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
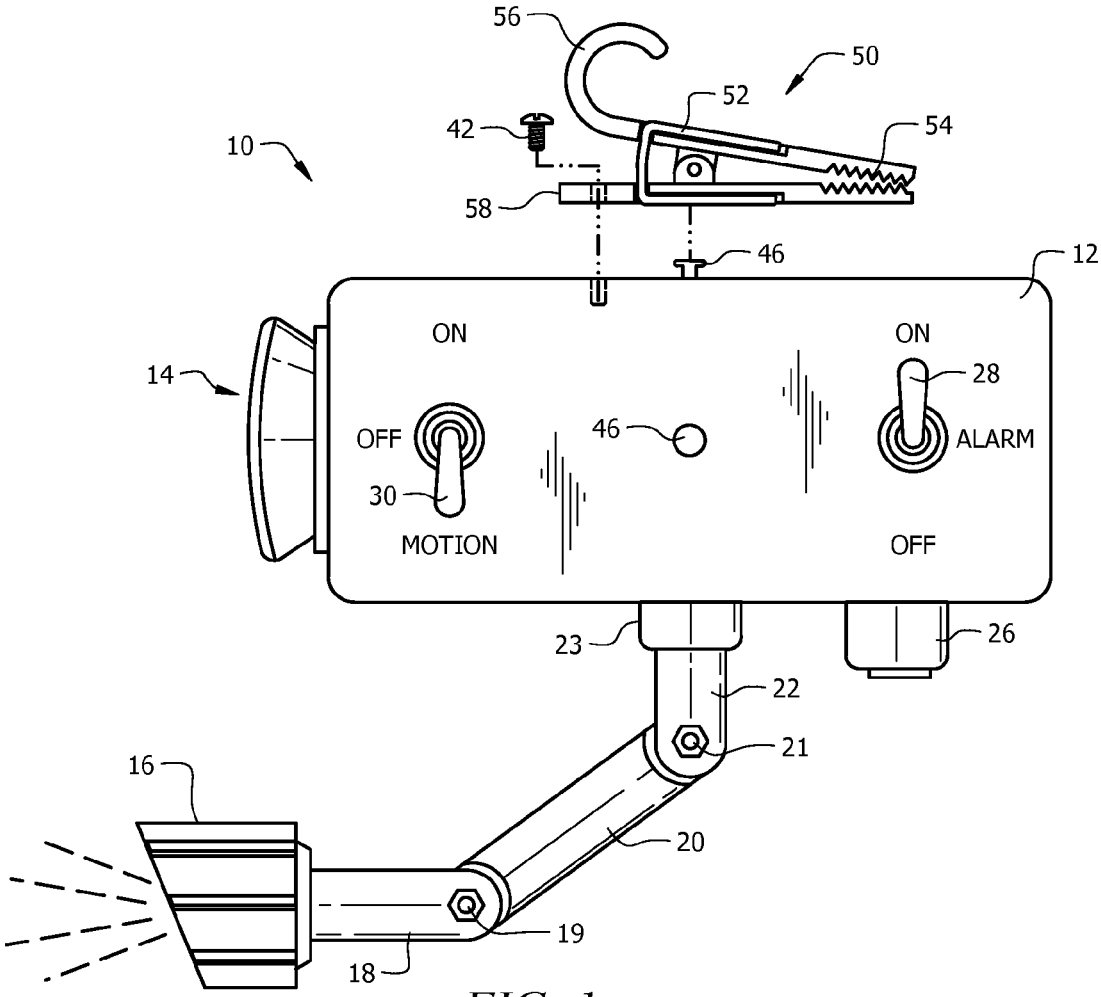
FIG. 1 illustrates a plan view of a marine alarm system of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a plan view of a system of the present invention is shown. The marine alarm system 10 of the present invention includes a base enclosure 12 and an attachment mechanism 50 for attaching to the various parts of a typical boat. In one embodiment of the present invention, the base enclosure 12 has one or more fasteners 46 for attaching the attachment mechanism 50 to the base enclosure 12. In this way, the attachment mechanism 50 is easily relocated to other locations on the base enclosure 12, thereby facilitating attachment to rails 2 or cloth 4 (see FIGS. 2 and 3) or other objects of varying orientation.

In the preferred embodiment, a mode switch 30 and an alarm on/off switch 28 are adapted to the base enclosure 12. The mode switch 30, in this embodiment, has three positions: On, Off and Motion. In the "On" position of the mode switch, the light 16 is continuously on, thereby providing light when needed. In the "Off" position, the alarm system 10 and light 16 are not powered. In the "Motion" position, the alarm system 10 is enabled to detect motion by way of the motion sensor 14. The motion sensor or motion detecting circuit 14 is a motion sensor as known in the industry and includes, but is not limited to infrared motion sensors and ultrasonic motion sensors. In general, such motion detection circuits include a sensor and circuitry to detect signals from the sensor and determine if the signals correspond to a specific target (e.g., a human subject). Such motion sensors/motion detecting circuits 14 are known and often used to turn on lights at night when a person is detected.

The alarm on/off switch 28 connects/disconnects the sounder 26 to the motion sensor. In the "On" position of the alarm on/off switch 28, when motion is detected by the motion detector 14, the light 16 illuminates and the sounder 26 makes noise. In the "Off" position of the alarm on/off switch 28, when motion is detected by the motion detector 14, the light 16 illuminates but the sounder 26 does not makes noise.

In the preferred embodiment, the light 16 is interfaced to the base enclosure 12 by, for example, a series of arms 18/20/22 and swivel adapters 19/21/23. These arms 18/20/22 and swivel adapters 19/21/23 enable aiming of the light 16 so that the light 16 will illuminate the desired area when either the mode switch 30 is set to "On" or the mode switch 30 is set to "Motion" and motion is detected.

In this exemplary embodiment, the attachment mechanism 50 includes a dual surface clip. A first end of the attachment mechanism 50 includes an arced end 56 that arcs more than 180 degrees. It is preferred that the arced end 56 is stiff, yet flexible so that it will expand around tubing 2 such as a boat rail (see FIG. 2) and then spring back to form, holding the arced end 56 around the tubing 2. The clip end 54 is spring loaded by a spring 52 similar to a clothespin or other similar clip. The clip end 54 preferably has teeth for holding the attachment mechanism to a cloth or similar surface such as a bimini top or other canvas. In some embodiments, a distal end 58 of the attachment mechanism 50 has a hole for inserting a screw 42 to secure the attachment mechanism 50 to the base enclosure 12.

Figure 2:
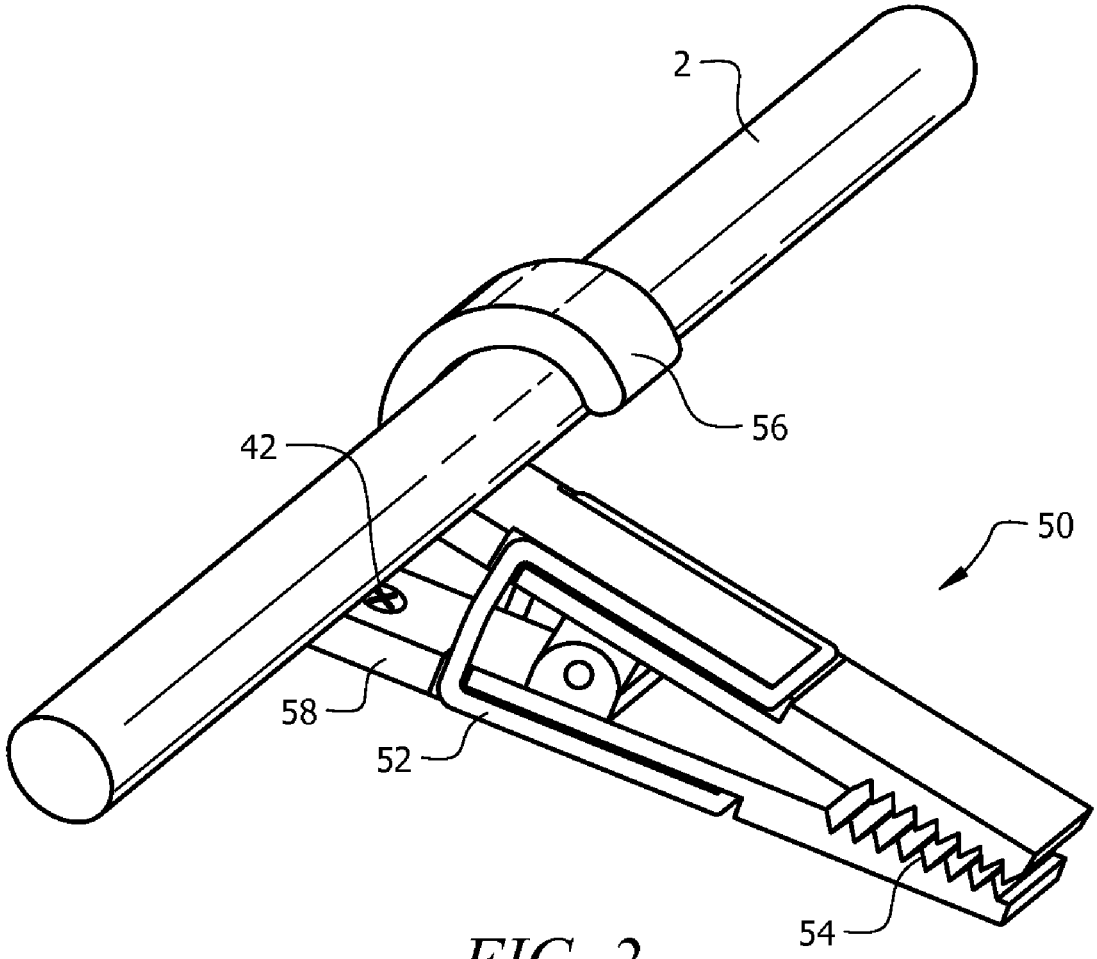
FIG. 2 illustrates a perspective view of an exemplary attachment mechanism of the marine alarm system of the present invention.

Referring to FIG. 2, a perspective view of an exemplary attachment mechanism 50 of the present invention is shown. The arced end 56 of the attachment mechanism 50 is shown snuggly snapped onto a rail 2 of a boat (tubing) or other cylindrical object (e.g., a flag pole, etc.) The arced end 56 arcs greater than 180 degrees and expands to accept the rail 2, then the arced end 56 springs back to its original shape to tightly hold the rail 2. It is anticipated that, in some embodiments, an inside surface of the arced end 56 is optionally lined with a non-skid surface such as rubber to hold the arced end 56 in position on a typical rail 2, which is often very smooth. The clip end 54 and spring 52 are shown, but not in use in this example. The distal end 58 is shown with the set screw 42.

Figure 3:
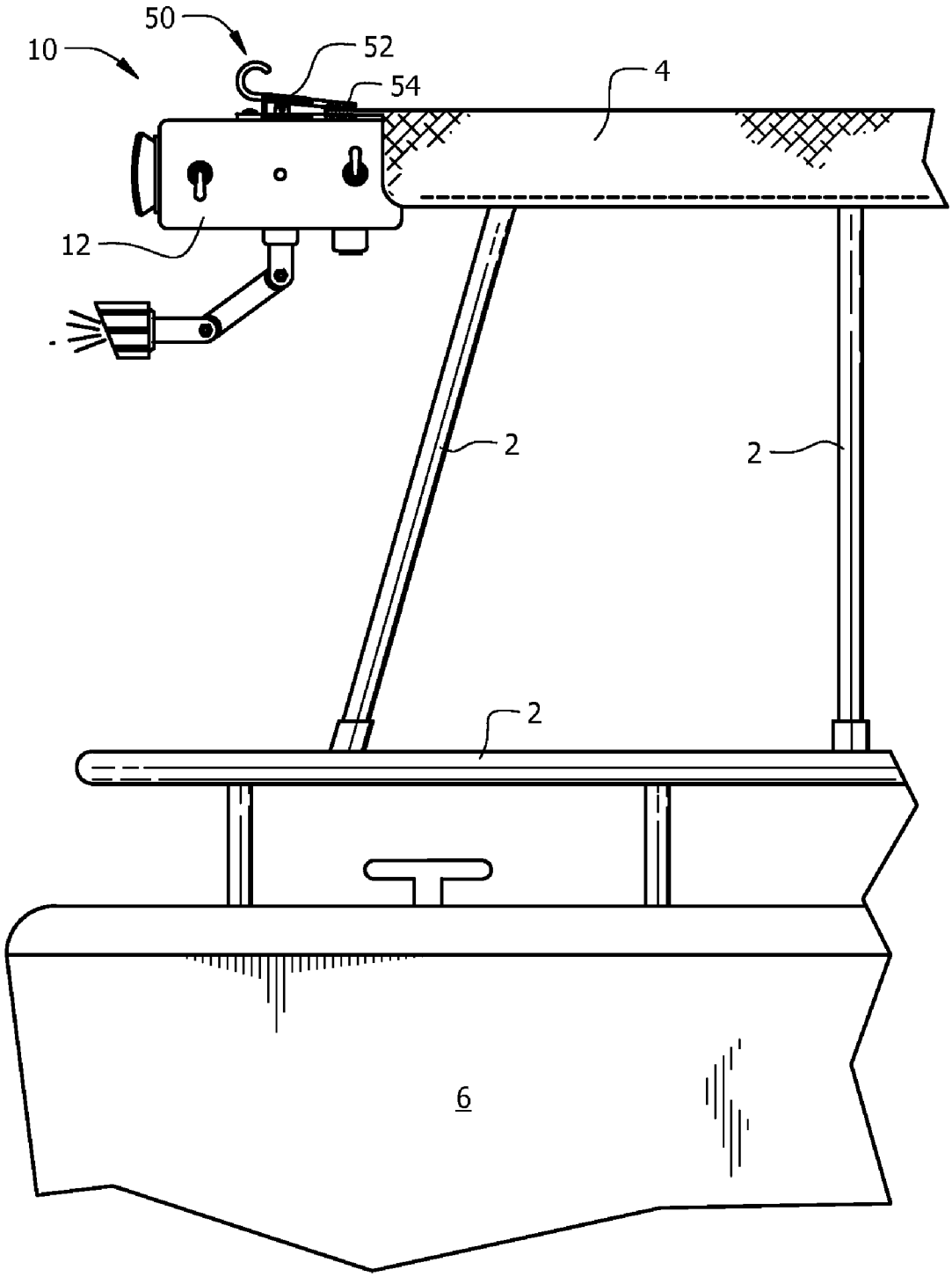
FIG. 3 illustrates a plan view of the marine alarm system of the present invention attached to a bimini top of a typical boat.

Referring to FIG. 3, a plan view of the marine alarm system 10 of the present invention attached to a bimini top 4 of a typical boat 6 is shown. The bimini top 4 is shown supported by a series of rails 2. The attachment mechanism 50 of the marine alarm system 10 is clipped to an edge of the bimini top 4 by the clip end 54 and is held in place by the spring 52.

Figure 4:
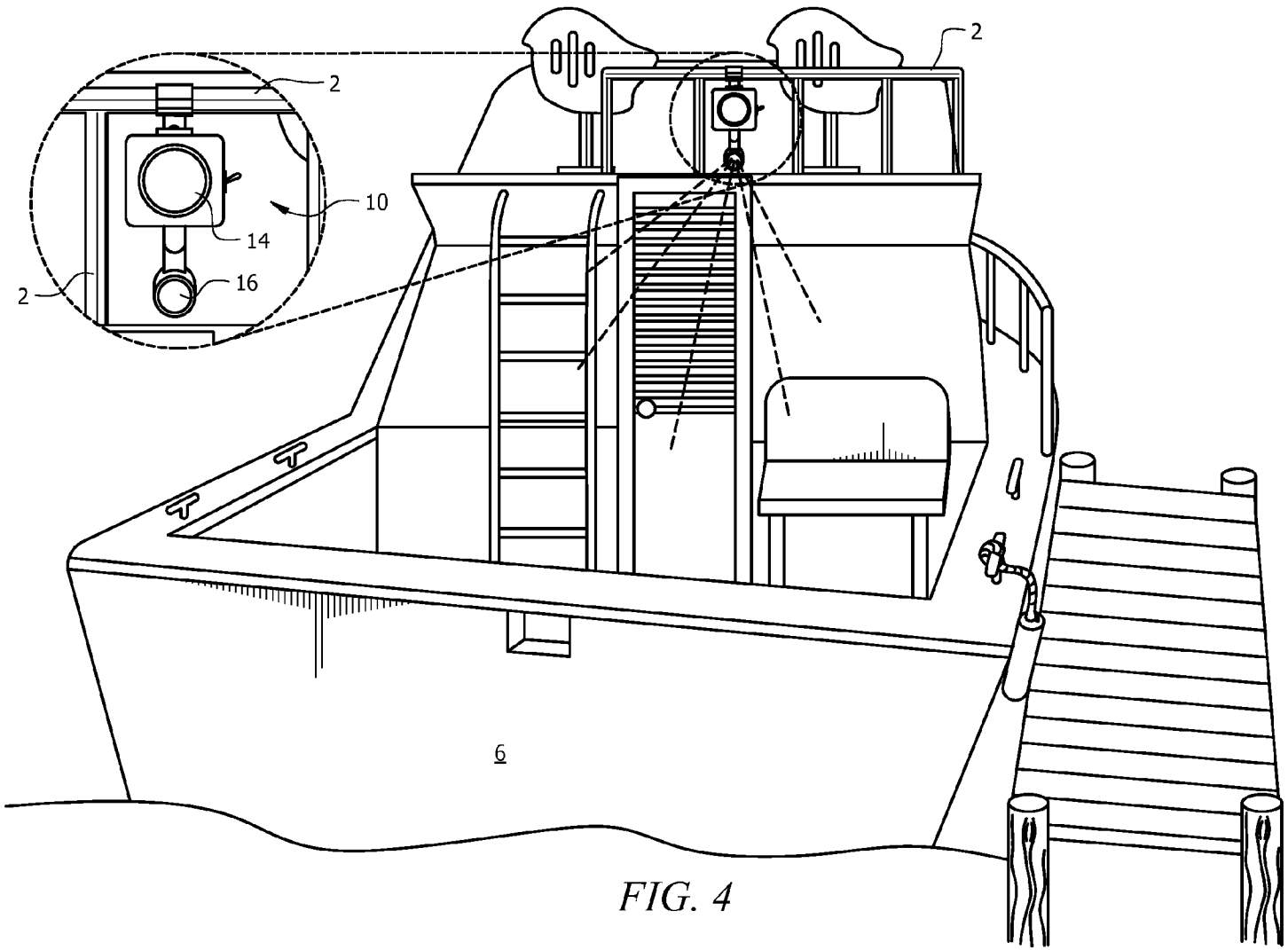
FIG. 4 illustrates a perspective view of the marine alarm system of the present invention attached to a rail of a typical boat.

Referring to FIG. 4, a perspective view of the system of the present invention attached to a rail 2 of a typical boat 6 is shown. For theft prevention/reduction, the marine alarm system 10 is mounted on a rail 2 of the boat 6, facing the stern of the boat 6. In this example, both the motion detector 14 and the light 16 are aimed toward the stern of the boat 6, so that, when an intruder boards the boat 6, the motion detector 14 detects the intruder and warns either the cabin occupants or anyone in the vicinity of the boat 6 that something is wrong. This visual and/or audible warning from the sounder 26 and/or the light 16 is often sufficient to ward off the thief and/or notify occupants and/or anyone in the vicinity of the boat 6 to notify the proper authorities.

Figure 5:
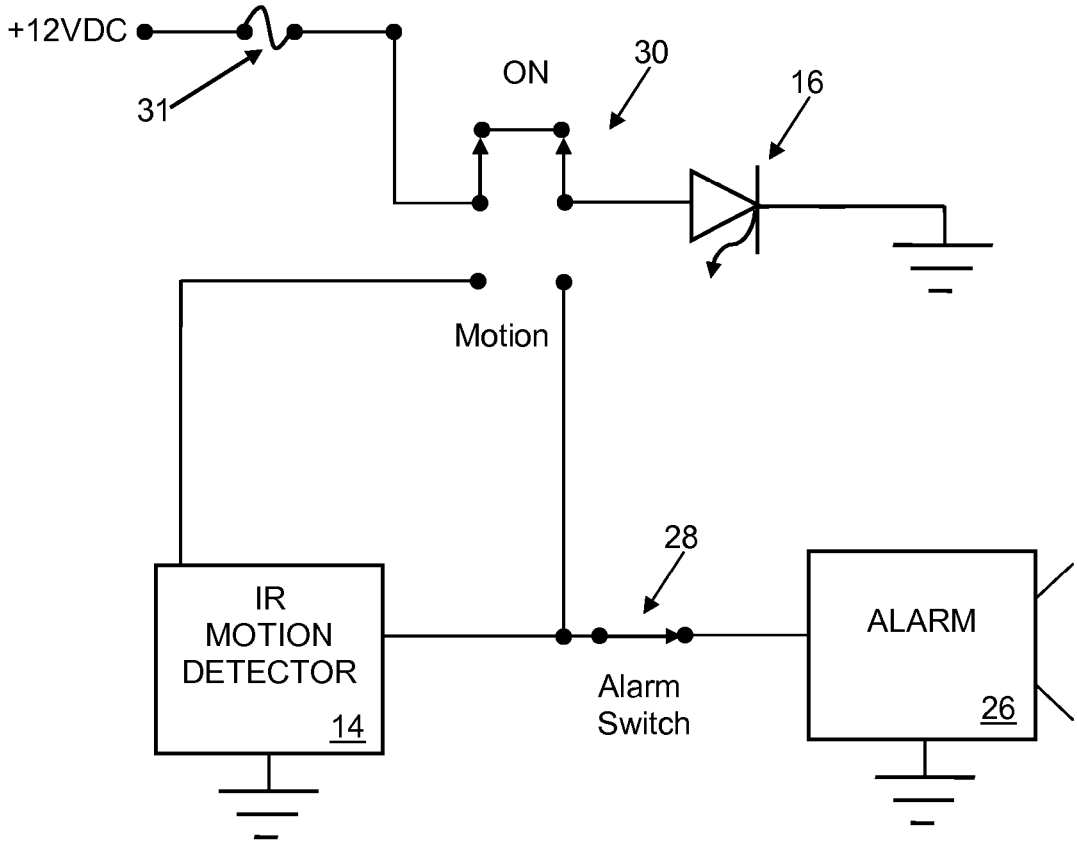
FIG. 5 illustrates a first schematic view of the present invention.

Referring to FIG. 5, a first schematic view of the present invention is shown. In this exemplary circuit, power is provided by, for example, the boat battery at 12 VDC. In this example, the 12 VDC power is routed through an optional fuse 31 and to the mode switch 30, which is shown in the "On" mode, in which, the 12 VDC power is connected to the light 16, thereby illuminating the light 16. It should be noted that the light 16 is shown as an LED and, for simplicity, the typical current limiting resistor is not shown or is integral to the LED. In alternate embodiments, other lights 16 are anticipated including incandescent lights, neon lights, fluorescent lights and xenon strobe lights, etc.

When the mode switch 30 is in the center position, the 12 VDC is not connected to anything (e.g., "off"). When the mode switch 30 is in the "Motion" position, the 12 VDC is connected to the motion detector 14 and the light 16 is connected to the output of the motion detector circuit 14. The output of this exemplary motion detector 14 is normally at ground potential. Upon detection of motion (e.g., an intruder), the output of this exemplary motion detector 14 goes to 12 VDC and, thereby, 12 VDC is provided to the light 16 and the alarm on/off switch 28. When the alarm on/off switch 28 is closed (as shown) the 12 VDC is then applied to the sounder 26 and noise is made by the sounder 26. When the alarm on/off switch 28 is open, 12 VDC is not applied to the sounder 26 and the sounder 26 remains silent. The sounder 26 is any known device that makes noise including piezoelectric sounders, electromagnetic sounders, voice-recordings through a speaker, etc.

Figure 6:
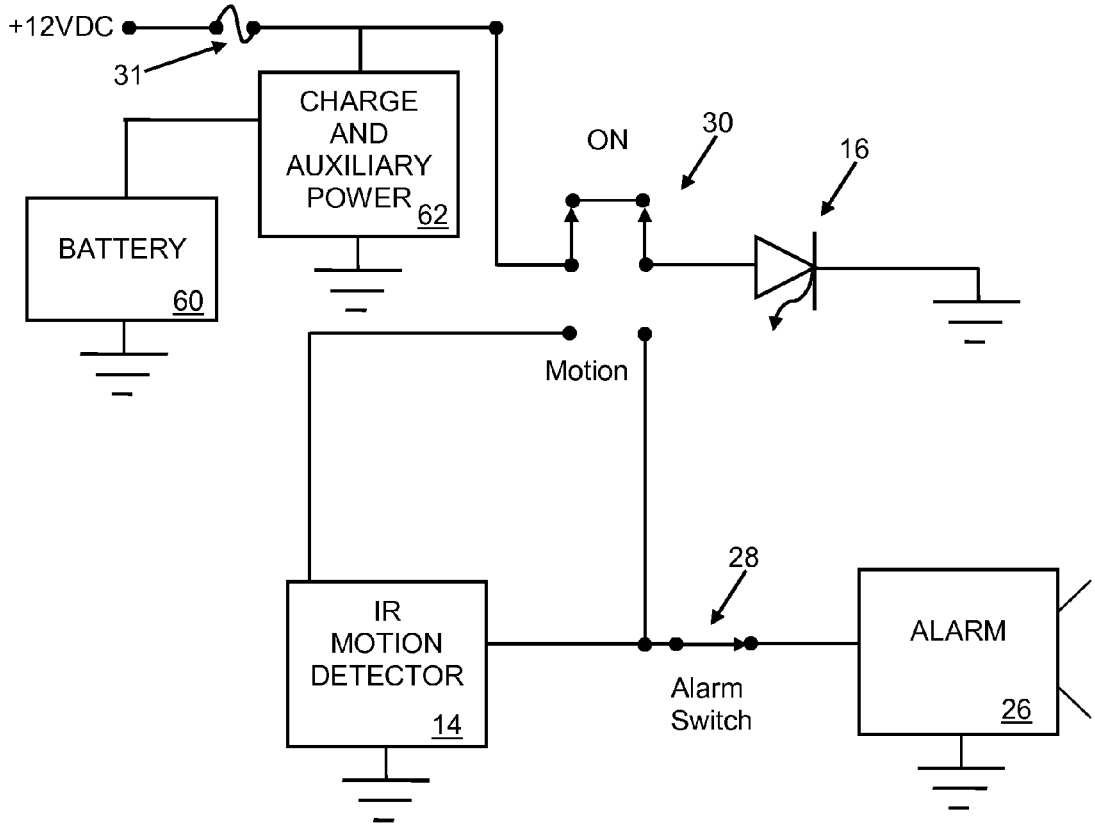
FIG. 6 illustrates a second schematic view of the present invention.

Referring to FIG. 6, a second schematic view of the present invention is shown. In this exemplary circuit, power is provided by, for example, the boat battery at 12 VDC. In this example, the 12 VDC power is routed through an optional fuse 31 and to a battery charging and auxiliary power circuit 62 as known in the industry. The battery charging and auxiliary power circuit 62 maintains a charged on a rechargeable battery 60 while 12 VDC is present and, if the 12 VDC is lost, the battery charging and auxiliary power circuit 62 provides power to the marine alarm system 10. The 12 VDC (or auxiliary power) is routed to the mode switch 30, which is shown in the "On" mode, in which, the 12 VDC power is connected to the light 16, thereby illuminating the light 16. It should be noted that the light 16 is shown as an LED and, for simplicity, the typical current limiting resistor is not shown or is integral to the LED. In alternate embodiments, other lights 16 are anticipated including incandescent lights, neon lights, fluorescent lights and xenon strobe lights, etc.

When the mode switch 30 is in the center position, the 12 VDC is not connected to anything (e.g., "off"). When the mode switch 30 is in the "Motion" position, the 12 VDC is connected to the motion detector 14 and the light 16 is connected to the output of the motion detector circuit 14. The output of this exemplary motion detector 14 is normally at ground potential. Upon detection of motion (e.g., an intruder), the output of this exemplary motion detector 14 goes to 12 VDC and, thereby, 12 VDC is provided to the light 16 and the alarm on/off switch 28. When the alarm on/off switch 28 is closed (as shown) the 12 VDC is then applied to the sounder 26 and noise is made by the sounder 26. When the alarm on/off switch 28 is open, 12 VDC is not applied to the sounder 26 and the sounder 26 remains silent. The sounder 26 is any known device that makes noise including piezoelectric sounders, electromagnetic sounders, voice-recordings through a speaker, etc.

Equivalent elements can be substituted for the ones set forth above such that they perform in substantially the same manner in substantially the same way for achieving substantially the same result. Other configurations of circuits having different polarities, more or less components and varying arrangements are anticipated. Although described in relationship to a boat, the present invention is anticipated to work equally as well on other vehicles or structures including, but not limited to: recreational vehicles, camping tents, out buildings, etc.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A marine alarm system comprising:

a base enclosure;

a source of power entering into the base enclosure;

a motion sensing circuit affixed to an outside surface of the base enclosure, the motion sensing circuit receiving power from the source of power;

an electric light, the electric light receiving power from the motion sensing circuit responsive to the motion sensing circuit detecting motion, the electric light positionably affixed to the outside surface of the base enclosure;

an audible alarm, the audible alarm receiving power through a mute switch from the motion sensing circuit responsive to the motion sensing circuit detecting the motion, the audible alarm affixed to the outside surface of the base enclosure, the mute switch preventing power from reaching the audible alarm when the mute switch is in the open position;

one or more fasteners affixed to the outside surface of the base enclosure; and an attachment mechanism, the attachment mechanism removably affixed to one of the one or more fasteners, the attachment mechanism having an arced clip at one end, the arced clip configured to secure the attachment mechanism to a rail of a boat, and, the attachment mechanism having a spring clip at a second end, the spring clip configured to secure the attachment mechanism to a cloth part of the boat.

2. The marine alarm system of claim 1, wherein the electric light is at least one light emitting diode.

3. The marine alarm system of claim 1, wherein the audible alarm is a piezoelectric sounder.

4. The marine alarm system of claim 1, further comprising a mode switch, the mode switch having three positions, a first position of the three positions connecting the source of power directly to the electric light, a second position of the three positions disconnecting the marine alarm system from the source of power and the third position of the three positions connecting the source of power to the motion sensing circuit.

5. The marine alarm system of claim 1, further comprising a set screw, the set screw passing through an appendage of the attachment mechanism and securing into the base enclosure, thereby securing the attachment mechanism to the base enclosure.

* * * * *